US008904650B2

(12) United States Patent
Flöter et al.

(10) Patent No.: US 8,904,650 B2
(45) Date of Patent: Dec. 9, 2014

(54) CUTTING TOOL WITH BLADE MADE OF FINE-CRYSTALLINE DIAMOND

(75) Inventors: André Flöter, Sontheim (DE); Stefan Strobel, Langenau/Hörvelsingen (DE); Peter Gluche, Bellenberg (DE)

(73) Assignee: GFD Gesellschaft für Diamantprodukte mbH (DE)

( * ) Notice: Subject to any disclaimer, the term of this patent is extended or adjusted under 35 U.S.C. 154(b) by 166 days.

(21) Appl. No.: 13/408,093

(22) Filed: Feb. 29, 2012

(65) Prior Publication Data

US 2012/0276826 A1 Nov. 1, 2012

(51) Int. Cl.
*B26B 21/58* (2006.01)
*B26B 21/60* (2006.01)

(52) U.S. Cl.
CPC ..... *B26B 21/60* (2013.01); *B26B 21/58* (2013.01)
USPC ..... 30/346.5; 451/552; 451/556; 30/50; 30/346.53; 30/346.54; 125/13.01; 83/651

(58) Field of Classification Search
CPC ..... B23D 47/12; B23D 61/026; B23D 61/28; B23D 59/001; B23D 61/18; B23C 3/12; B24B 1/00; B24B 21/006; B24B 21/06; B28D 1/04; B28D 1/045; B28D 1/02; B28D 1/041; B28D 1/18; B28D 1/86; B26B 21/58; B26B 21/60
USPC ..... 451/556, 552; 83/651; 125/13.01, 15, 125/22, 5; 30/346.5, 346–357, 50
See application file for complete search history.

(56) References Cited

U.S. PATENT DOCUMENTS

| | | | | | |
|---|---|---|---|---|---|
| 2,359,198 | A | * | 9/1944 | Bowers | 30/32 |
| 3,797,110 | A | * | 3/1974 | Michelson | 30/82 |
| 4,211,006 | A | * | 7/1980 | Halaby et al. | 30/346.55 |
| 5,129,289 | A | * | 7/1992 | Boland et al. | 76/104.1 |
| 5,142,785 | A | * | 9/1992 | Grewal et al. | 30/32 |
| 5,152,810 | A | * | 10/1992 | Rue et al. | 51/309 |
| 5,232,568 | A | * | 8/1993 | Parent et al. | 204/192.3 |
| 5,295,305 | A | * | 3/1994 | Hahn et al. | 30/50 |
| 5,669,144 | A | * | 9/1997 | Hahn et al. | 30/346.54 |
| 5,763,879 | A | * | 6/1998 | Zimmer et al. | 850/3 |
| 5,795,648 | A | * | 8/1998 | Goel et al. | 428/336 |

(Continued)

FOREIGN PATENT DOCUMENTS

| | | |
|---|---|---|
| DE | 102004031956 | 1/2006 |
| DE | 102004052068 A1 | 4/2006 |

(Continued)

OTHER PUBLICATIONS

"European Application No. 11001694, EP Search Report mailed Aug. 2, 2011", 3 pgs.

(Continued)

*Primary Examiner* — George Nguyen
(74) *Attorney, Agent, or Firm* — Schwegman Lundberg & Woessner, P.A.

(57) ABSTRACT

The present invention relates to a cutting tool, in particular in the form of a razor blade, a scalpel, a knife, a machine knife, scissors etc., which has a synthetic diamond layer with a cutting edge. The diamond layer thereby consists of fine-crystalline diamond.

20 Claims, 6 Drawing Sheets

(56) References Cited

U.S. PATENT DOCUMENTS

Figure 1:
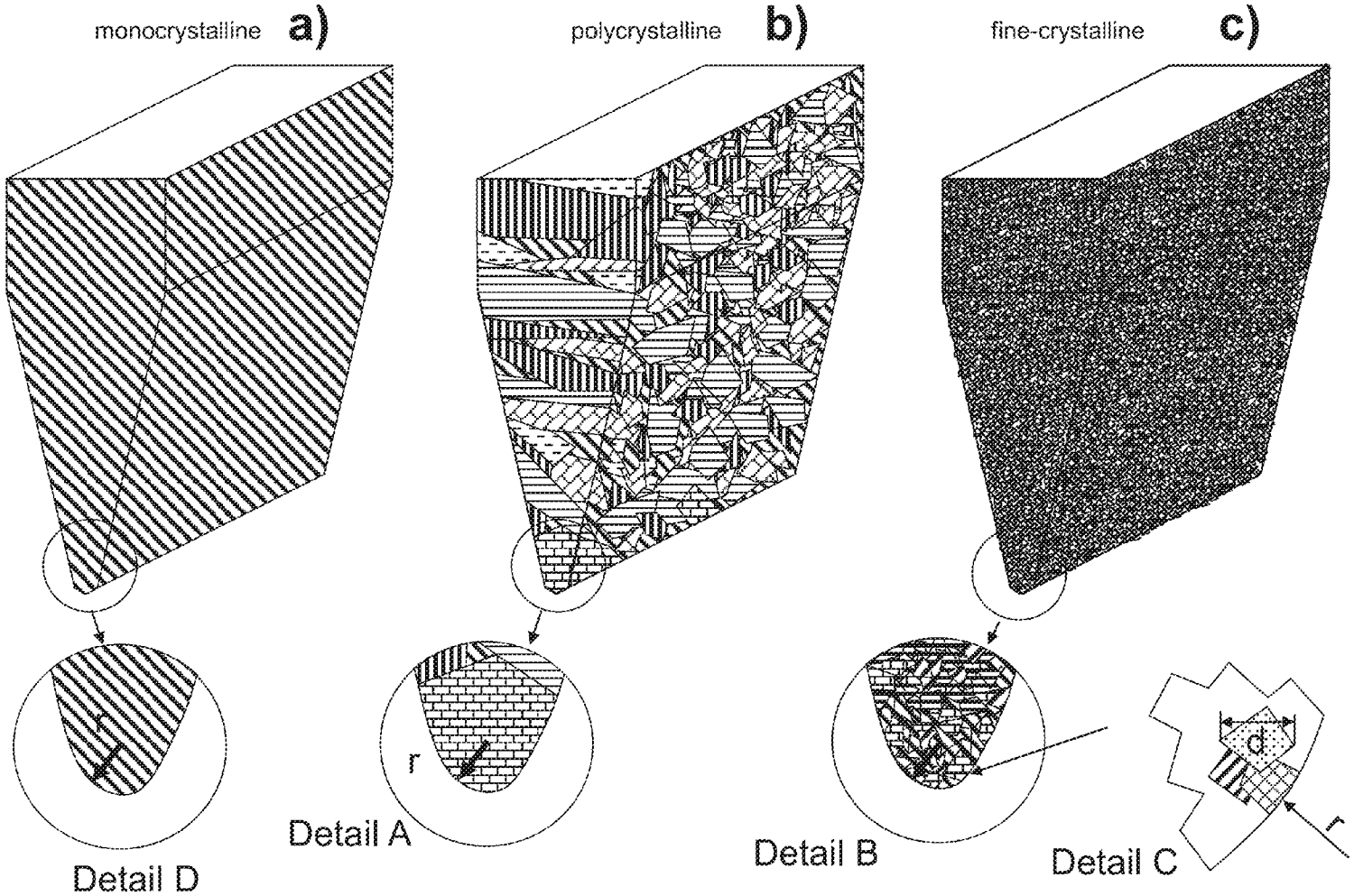

| | | | | |
|---|---|---|---|---|
| 5,955,155 | A * | 9/1999 | Yamamoto et al. | 427/577 |
| 6,004,362 | A * | 12/1999 | Seals et al. | 51/295 |
| 6,289,593 | B1 | 9/2001 | Decker et al. | |
| 6,599,178 | B1 * | 7/2003 | Gluche et al. | 451/540 |
| 6,623,339 | B1 * | 9/2003 | Igarashi et al. | 451/42 |
| 6,656,591 | B2 * | 12/2003 | Liu et al. | 428/408 |
| 7,060,367 | B2 * | 6/2006 | Yamada et al. | 428/634 |
| 7,387,742 | B2 * | 6/2008 | Daskal et al. | 216/53 |
| 7,396,484 | B2 * | 7/2008 | Daskal et al. | 216/101 |
| 7,585,366 | B2 * | 9/2009 | Sung | 117/79 |
| 8,545,997 | B2 * | 10/2013 | Elkouby et al. | 428/697 |
| 2002/0071949 | A1 * | 6/2002 | Liu et al. | 428/325 |
| 2003/0154840 | A1 * | 8/2003 | O'Brien | 83/835 |
| 2004/0050213 | A1 * | 3/2004 | Forsberg et al. | 76/101.1 |
| 2004/0097168 | A1 * | 5/2004 | Igarashi et al. | 451/5 |
| 2005/0028389 | A1 | 2/2005 | Wort et al. | |
| 2006/0016127 | A1 * | 1/2006 | Sung | 51/293 |
| 2008/0196704 | A1 * | 8/2008 | Georgiadis et al. | 125/5 |

FOREIGN PATENT DOCUMENTS

| | | | |
|---|---|---|---|
| DE | 60210449 | T2 | 11/2006 |
| WO | WO-98/04382 | A1 | 2/1998 |
| WO | WO-99/37437 | A1 | 7/1999 |
| WO | WO-03/101683 | A1 | 12/2003 |
| WO | WO-2011/008617 | | 1/2011 |

OTHER PUBLICATIONS

"European Application Serial No. 11001694.6, Office Action mailed Jul. 17, 2013", (w/ English Translation), 4 pgs.

"European Application Serial No. 11001694.6, Office Action mailed Jul. 31, 2013", (w/ English Translation), 4 pgs.

"European Application Serial No. 11001694.6, Response filed Jul. 23, 2013 to Office Action mailed Jul. 17, 2013", (w/ English Translation of Amended Claims), 10 pgs.

Morrell. R., et al., "Meso-scale mechanical testing methods for diamond composite materials", *Int. Journal of Refractory Metals & Hard Materials*, 28, (2010), 508-515.

* cited by examiner

CUTTING TOOL WITH BLADE MADE OF FINE-CRYSTALLINE DIAMOND

CLAIM OF PRIORITY

This application claims the benefit of priority under 35 U.S.C. §119 (a)-(d) of European Patent Application Ser. No. 11 001 694.6-2313, entitled "SCHNEIDWERKZEUG MIT KLINGE AUS FEINKRISTALLINEM DIAMANT," filed on Mar. 1, 2011, the benefit of priority of which is claimed hereby, and which is incorporated by reference herein in its entirety.

The present invention relates to a cutting tool, in particular in the form of a razor blade, a scalpel, a knife, a machine knife, scissors etc., which has a synthetic diamond layer with a cutting edge. The diamond layer thereby consists of fine-crystalline diamond.

Cutting tools, such as for example knives and scalpels, which have diamond layers have been known already for a fairly long time from the state of the art. These cutting tools can thereby be formed completely from a diamond layer (complete diamond blade), the possibility can likewise be provided that a synthetic diamond layer is applied on a substrate suitable for this purpose. Generally, the cutting edge of the cutting tool is thereby configured in the diamond layer since diamond is the hardest best-known material.

These blades are distinguished, relative to for example steel blades, by a greater cutting ability (sharpness) and also a greater edge-holding property (lifespan, serviceable life).

Examples of the previously described diamond blades having such a construction in principle are found in publications WO 99/37437, DE 602 10 449 12, WO 03/101683, DE 10 2004 052 068 A1 and also WO 98/04382 A1.

The diamond materials which are used for the blades known from the state of the art are thereby either polycrystalline diamond materials or, on the other hand, also the use of monocrystalline diamond is possible.

Diamond materials of this type have however a series of disadvantages.

Monocrystalline diamond is extremely difficult to produce and to machine, on the one hand, and, on the other hand, it is very expensive so that it is likely to be unsuitable for use in mass-produced products, such as for example razor blades.

Polycrystalline diamond layers, as are used in the state of the art, are distinguished by a clearly heterogeneous distribution of the size of the crystalline domains. Typically, the sizes of the crystalline regions in the case of polycrystalline diamond vary over several orders of magnitude. Distributions in which the greatest occurring crystallite domains have a diameter which is greater by a factor 100 than the diameter of the smallest occurring crystalline domains are hereby found, typical values for the average size of the crystallites $d_{50}$ being between 2 and 100 pin. According to this definition, at least 50% of the crystallites are present with an average size between 2 and 100 μm. Such a polycrystalline diamond, layer is hence very heterogeneous but economical to produce.

In the case of such polycrystalline heterogeneous diamond layers, it has proved to be disadvantageous that, because of the heterogeneity of the crystalline domains, these blades are exceptionally difficult to sharpen. Even in the case where a reliable cutting edge, i.e. a smooth and diamond, it can be observed that, because of the heterogeneous crystal domains, jaggedness can be observed even when first used. This can be attributed to the high cutting forces occurring on the cutting edge during the cutting process, a certain proportion of crystallites which are present always detaching from the crystallite composite. The size of the flake is thereby based on the grain size. For example when being used as a razor blade, this is however undesirable since such jaggedness or flakes rapidly lead to a loss of cutting ability and edge-holding or to an increase in the cutting forces, which can manifest itself for example in a painful feeling during shaving since injury to the skin can occur.

Because of the polycrystalline structure and the formation of a texture, polycrystalline diamond layers have high surface roughness on the growth side. This is generally above rms. >1 μm.

Hence, this makes subsequent polishing of polycrystalline layers necessary in order to obtain smooth surfaces.

Furthermore, polycrystalline diamond layers, in transverse fracture, have a columnar structure, i.e. the grain boundaries extend essentially perpendicular to the substrate surface. Since the grain boundary represents a macroscopic defect, it acts like a predetermined breaking point. Unfavourably, polycrystalline diamond layers include a large number of these predetermined breaking points and are therefore very susceptible to breakage. Thus for instance the transverse rupture stress $\sigma_0$ in polycrystalline layers is for instance at approx. 1/10 of that of monocrystalline diamond.

Because of the heterogeneous construction of polycrystalline diamond layers, these also generally have internal mechanical stresses which manifest themselves macroscopically by distortion of the layers. In addition to the problems of bending (distortion) of the cutting edge which are associated therewith, these in addition reduce the stress at failure and hence lead to increased susceptibility to breakage.

Starting from the disadvantages known from the state of the art, it is therefore the object of the present invention to indicate a cutting tool which can be produced economically and reliably, has an at least equally high edge-holding property and cutting ability relative to the diamond blades known from the state of the art and in the case of which flakes, as are known with polycrystalline diamond cutting tools, occur only to a subordinate degree.

This object is achieved, with respect to a cutting tool, by the features of patent claim 1 and also, with respect to a method for the production of the cutting tool according to the invention, by the features of patent claim 14. Purposes of use of the cutting tool according to the invention are indicated by patent claim 15. The respective dependent patent claims thereby represent advantageous developments.

According to the invention, a cutting tool which includes a synthetic diamond layer which has a cutting edge is hence provided. The cutting edge is thereby distinguished by a profile with a reducing layer thickness, the diamond layer consisting of fine-crystalline diamond.

According to the invention, a diamond layer is understood by fine-crystalline diamond, the crystalline domains having an average grain size $d_{50} \leq$of 500 nm. There is understood hereby that, at least in 50% of the crystallites, any dimension of an individual crystallite is 500 nm. The fine-crystalline diamond layer is hence distinguished by extremely high homogeneity of the crystallites.

Surprisingly, it was able to be found that, in the case of cutting edges which are formed from such fine-crystalline diamond layers, detachment, as is known of polycrystalline diamond, is quasi-completely suppressed. Relative to monocrystalline diamond, it has been shown that production of fine-crystalline diamond, compared to the production of monocrystalline diamond, can be accomplished substantially more easily and economically. Hence, also longer and/or larger-area diamond blades can be provided, as are used for example in razors, which has not to date been possible with diamond blades made of monocrystalline diamond.

Because of the extremely high transverse rupture stress of the fine-crystalline diamond ($\sigma_0$~5.7 GPa), it is achieved that, despite high local mechanical stress, detachment of individual crystallites from the fine-crystalline diamond layer, in particular from the cutting edge, is almost completely suppressed. Even with fairly long-term use, the cutting tool therefore retains its original sharpness.

With respect to the definition of transverse rupture stress $\sigma_0$, reference is made to the following literature references:

R. Morrell et al., int. Journal of Refractory Metals & Hard Materials, 28 (2010), p. 508 515;

R. Danzer et al. in "Technische kerarnische Werkstoffe" (Technical ceramic materials), published by J. Kriegesmann, HvB Press, Ellerau, ISBN 978-3-938595-00-8, chapter 6.2.3.1—"Der 4—Kugelversuch zur Ermittlung der biaxialen Biegefestigkeit spröder Werkstoffe" (the 4-ball test for determining the biaxial bending strength of brittle materials).

The transverse rupture stress $\sigma_0$ is thereby determined by statistical evaluation of breakage tests, e.g. in the B3B load test according to the above literature details. It is thereby defined as the breaking stress at which there is a probability of breakage of 63%.

Since fine-crystalline diamond layers, with respect to their grain size distribution, are more homogeneous than polycrystalline diamond layers, the material also has fewer inherent stresses. Consequently, macroscopic distortion of the cutting edge is less probable.

The cutting tools according to the invention can thereby be configured symmetrically or asymmetrically with respect to the cutting edge. In particular, it is possible that the cutting tool can have a chamfer, i.e. a second angle on the cutting edge.

A preferred embodiment provides that the average grain size $d_{50}$ of the fine-crystalline diamond is 100 nm, further preferred between 5 and 100 nm, particularly preferred between 10 and 70 nm.

A further preferred embodiment provides that the proportion of sp- and $sp^2$ bonds of the fine-crystalline diamond layer is between 0.5 and 10%, preferably between 2 and 9%, particularly preferred between 3 and 8%. A higher $sp^2$ proportion thereby has the effect that the modulus of elasticity of the fine-crystalline diamond layer is somewhat reduced. At the same time, the hardness of this material likewise falls. As a result, the fine-crystalline diamond layers become in total more flexible and more elastic and can be adapted better to the item to be cut or the contour of the item to be cut.

The cutting edge ideally has a round configuration, the rounded radius r of the diamond layer at the cutting edge is thereby preferably between 3 and 100 nm, preferably between 15 and 70 nm, particularly preferred between 20 and 50 nm.

Particularly good results with respect to the cutting ability are produced if the cutting angle $\beta$ is between 10 and 40°, preferably between 10° and 30°, particularly preferred between 15° and 25°.

In a further preferred embodiment, the rounded radius r is coordinated to the average grain size $d_{50}$ of the fine-crystalline diamond. It is hereby advantageous in particular if the ratio between the rounded radius r of the diamond layer at the cutting edge and the average grain size $d_{50}$ of the fine-crystalline diamond $r/d_{50}$ is between 0.03 and 20, preferably between 0.05 and 15, particularly preferred between 0.5 and 10.

A first particularly preferred alternative of the present invention provides that the cutting tool is formed completely from the diamond layer, the diamond layer having a thickness of 10 to 1,000 μm, preferably 10 to 500 μm, particularly preferred 20 to 250 μm. In this embodiment, the cutting tool is configured as a complete diamond blade.

A likewise preferred further alternative of the present invention provides that the diamond layer is disposed on a substrate material, the diamond layer having a thickness of up to 1 and 500 μm, preferably 5 to 200 μm. The cutting edge is thereby configured in the diamond layer.

This embodiment is advantageous with respect to the fact that the diamond layer can be configured with a lesser layer thickness than in the case of a complete diamond blade, savings resulting with respect to the diamond, material which is relatively expensive and complex to produce. The function of reinforcing the blade can thereby be assumed by the substrate.

Preferred substrate materials are thereby selected from the group consisting of metals, such as titanium, nickel, chromium, niobium, tungsten, tantalum, molybdenum, vanadium, platinum, iron-containing materials, such as steel and/or germanium; from carbon- and/or nitrogen- or boron-containing ceramics, such as silicon carbide, silicon nitride, boron nitride, tantalum carbide, tungsten carbide, molybdenum carbide, titanium nitrides, TiAlN, TiCN and/or $TiB_2$, glass ceramics, such as e.g. Zerodur® or Pyrex®; composite materials made of ceramic materials in a metallic matrix (cermets); hard metals; sintered carbide hard metals, such as e.g. cobalt- or nickel-bonded tungsten carbides or titanium carbides; silicon, glass or sapphire; and also mono- or polycrystalline diamond and/or diamond-like carbon layers.

It is preferred furthermore if the gradient of the average grain size of the fine-crystalline diamond, measured in the direction of the thickness of the fine-crystalline diamond layer, is <300%, preferably <1.00% particularly preferred. <50%. This embodiment provides that the average grain size diameter of the fine-crystalline domains of the diamond layer is distributed through the entire layer thickness relatively uniformly to particularly uniformly, i.e. the grain sizes on the one side of the diamond layer are approximately of the same size as on the other side of the diamond layer; of course, an almost or an entirely complete homogeneity of the fine-crystalline domains of the diamond layer is thereby particularly advantageous. The gradient is determined by determining the average grain size diameter $d_{50}$ on one side of the diamond layer and placing it in a relationship with respect to the average grain size diameter on the opposite side of the diamond layer.

A further preferred embodiment of the present invention provides that there is applied, between the substrate and the fine-crystalline diamond layer, at least one first adhesive layer, preferably made of silicon carbide, silicon nitride, tungsten, titanium or silicon. This embodiment ensures good retention of the diamond layer on the substrate. The first adhesive layer thereby increases the strength of the mechanical bond between core and fine-crystalline diamond layer and hence enables reliable further processing.

Irrespective of the previously mentioned embodiment, according to a particularly preferred variant of the invention, there is applied, on the fine-crystalline diamond layer, at least one second adhesive layer, preferably made of Cr, Pt, Ti or W, and thereupon a sliding layer, in particular a polymer layer, preferably a PTFE layer (Teflon), carbon layer, preferably a graphite layer and/or a DLC layer. The second adhesive layer likewise serves for better bonding of the sliding layer to the fine-crystalline diamond layer. The sliding layer serves to minimise friction. In the case where carbon layers, graphite- or DLC layers are used as sliding layer, the second adhesive layer can even be dispensed with since direct bonding of the carbon layers to the fine-crystalline diamond, layer is possible. The sliding layer thereby serves to minimise friction between the cutting tool and item to be cut. Likewise, minimisation of dirt adhesion, avoidance of cutting dust and also a reduction in cutting forces is achieved. In the case of a previously described complete diamond blade, these additional coatings can be present for example locally in the region of the cutting edge, likewise the complete cutting tool can be provided with these coatings.

In the case of a cutting tool which has a diamond layer disposed on a substrate, the previously described additional coatings can likewise be applied for example in the region of the edges of the cutting tool which form the cutting edge. Likewise, complete covering of the cutting tool or at least of the surfaces of the diamond layer is however possible.

In a further advantageous embodiment, the diamond layer has an average surface roughness of $R_A$<5 μm, preferably <2 μm, particularly preferred <1 μm. This makes additional mechanical polishing of the grown diamond surface superfluous.

A further preferred variant provides that the cutting edge has notches or cuts at regular spacings, preferably at regular spacings of less than 10 mm. Preferred spacings are thereby for example between 5 and 9 mm. These notches enable guidance of the blade relative to the item to be cut and hence stabilisation of the cutting tool during the cutting process.

In particular, the cutting tool can be configured as a blade, knife blade, razor blade, scalpel, knife, machine knife, scissors or shearing machine or can be used as such. Likewise, it is possible that the cutting tool is configured as a shaving system, i.e. as a head with a plurality of razor blades or can be used as such. All the razor blades are thereby configured as a cutting tool according to the invention.

In a preferred embodiment, the transverse rupture stress Go of the diamond layer is >2 GPa, preferably >4 GPa, particularly preferred >5 GPa, $\sigma_0$ is thereby defined as above.

In a further preferred embodiment, the modulus of elasticity of the diamond layer is <1,200 GPa, preferably <900, particularly preferred <750 GPa.

A further preferred embodiment provides that the crystallites of the fine crystalline diamond layer are grown preferably in <100>-, <110>- and/or <111>-direction, i.e. a texture is present. This can result from the production process in which the growth rate of certain crystal directions can be specifically preferred. This anisotropic texture of the crystallites has a likewise positive influence on the mechanical properties.

According to the invention, a method for the production of a previously described cutting tool is likewise indicated, in which the following steps are implemented:

a) provision of a synthetic, fine-crystalline diamond layer,
b) one- or two-sided cutting of the fine-crystalline diamond layer at an angle α which is between 50° and 85°, preferably between 60° and 80°, further preferred between 65° and 75°, to the surface normal of the fine-crystalline diamond layer, at least one fragment with a cutting edge being produced, and also
c) resharpening of the cutting edge by means of a plasma- or ion etching process.

In the case of one-sided cutting of the monocrystalline diamond layer, an asymmetrical cutting tool is thereby produced. Cutting of the diamond layer is thereby implemented at a given angle α. A fragment is thereby produced which has a blunt edge at the two surfaces delimiting the diamond layer, which blunt edge has an angle >90°, and also a sharp edge which has an angle <90°. This sharp edge later forms the cutting edge, i.e. after resharpening. In principle, the relationship α+β=90° between angle α and cutting angle β thereby applies. Due to the resharpening, possibly deviations from the above-mentioned relationship can occur.

However, it is likewise possible to cut the fine-crystalline diamond layer from both sides. The fine-crystalline diamond layer is thereby cut through from both flat sides respectively at an angle α, preferably the same angles α being chosen for the cuts from both sides. In the case where the fine-crystalline diamond layer is cut from both sides at the same angle and at the same level, also cutting tools with symmetrical cutting edges can hence be produced in this way, as represented for example in FIG. 2*b*. In principle, there applies for such blades the relationship α+γ=90° (with γ=β/2) between angle α and cutting angle β. Due to resharpening, possibly certain deviations from the above-mentioned relationship can occur.

The relationship between the angles α, β and γ is represented and explained for example also in FIGS. 2*b* and 2*e*.

According to whether the fine-crystalline diamond layer is cut from one or from both sides, as is evident from the previous embodiments, another angle α, at which the fine-crystalline diamond layer is cut, must be chosen in order to reach the same cutting angles β. However, it must always thereby be preferred that—irrespective of whether the fine-crystalline diamond layer is cut from one or from both sides—a cutting angle β between 10 and 40°, preferably 10 and 30°, further preferred between 15 and 25°, is present after the cutting process.

According to this general first embodiment, for example an asymmetrical or symmetrical complete diamond blade can thereby be achieved. The synthetic, fine-crystalline diamond layer, provided in the first step, can thereby be produced on a planar substrate by means of standard methods known from the state of the art. It is thereby important merely that the average grain size diameter $d_{50}$ of the crystalline domains in the fine-crystalline diamond layer is ≤500 nm. By means of subsequent removal of the substrate by suitable methods, the fine-crystalline diamond layer is obtained, in isolation.

The cutting step can thereby be implemented by all possible ways, such as e.g. laser cutting, plasma- or ion etching, water-jet cutting or mechanical machining. When implementing the cutting step, the cutting angle of the resulting cutting tool is thereby prescribed already. With respect to the cutting edge, two identical fragments are thereby formed in the ideal case, with suitable implementation of the cutting step both acute-angled ends of the diamond layer are already suitable for the purpose of being used as cutting edge of the cutting tool.

In the methods for the production of the complete diamond blade which are described further back, it is preferred if provision of the fine-crystalline diamond, layer is effected by applying the fine-crystalline diamond layer on a substrate and also subsequent partial or complete removal of the substrate.

The possible removal of the planar substrate can be effected before or even after carrying out the cutting step. Possibly, the substrate can also be retained and contribute to the mechanical stability (sandwich construction).

The resharpening taking place subsequent to the cutting step by means of a plasma- or ion etching process is likewise possible by means of plasma etching methods which are already known from the state of the art.

In a further embodiment of the method, the synthetic, fine-crystalline diamond layer is deposited on a substrate and, subsequent thereto, steps b) and c) are implemented.

According to this special embodiment, the diamond blade which is described further back and has a fine-crystalline diamond layer applied on a substrate can be produced. With respect to the individual steps, reference is also made to the embodiments already made further back.

The fine-crystalline diamond layer can be produced such that diamond seed crystals are deposited on the substrate in order to apply the fine-crystalline diamond layer and, on the diamond seed crystals, the fine-crystalline diamond layer is deposited, for example via CVD methods.

A method control for the production of the fine-crystalline diamond layer, given by way of example, is indicated subsequently:

EXAMPLE

The fine-crystalline diamond layers are produced for example by means of a "hot wire CAM method". In this method, a gas phase consisting of e.g. 1 to 5% by vol. of $CH_4$ and 95 to 99% by vol. of hydrogen is activated in a vacuum chamber by means of hot wires, e.g. tungsten wires. The wire temperature is for example in a range of 1,800° C. to 2,400° C. With a spacing between the substrate and the wires of 1 cm to 5 cm, a substrate temperature of 600° C. to 900° C. is thereby set. The pressure of the gas atmosphere is between 3 mbar and 30 mbar. Deposition of the fine-crystalline diamond layer on the substrate is thereby effected.

The cutting which is implemented in step b) in the above-mentioned variants of the method can be effected for example by means of a laser, by means of wire erosion, by means of water jet, by means of plasma- or ion etching, or by means of mechanical methods.

Figure 2:
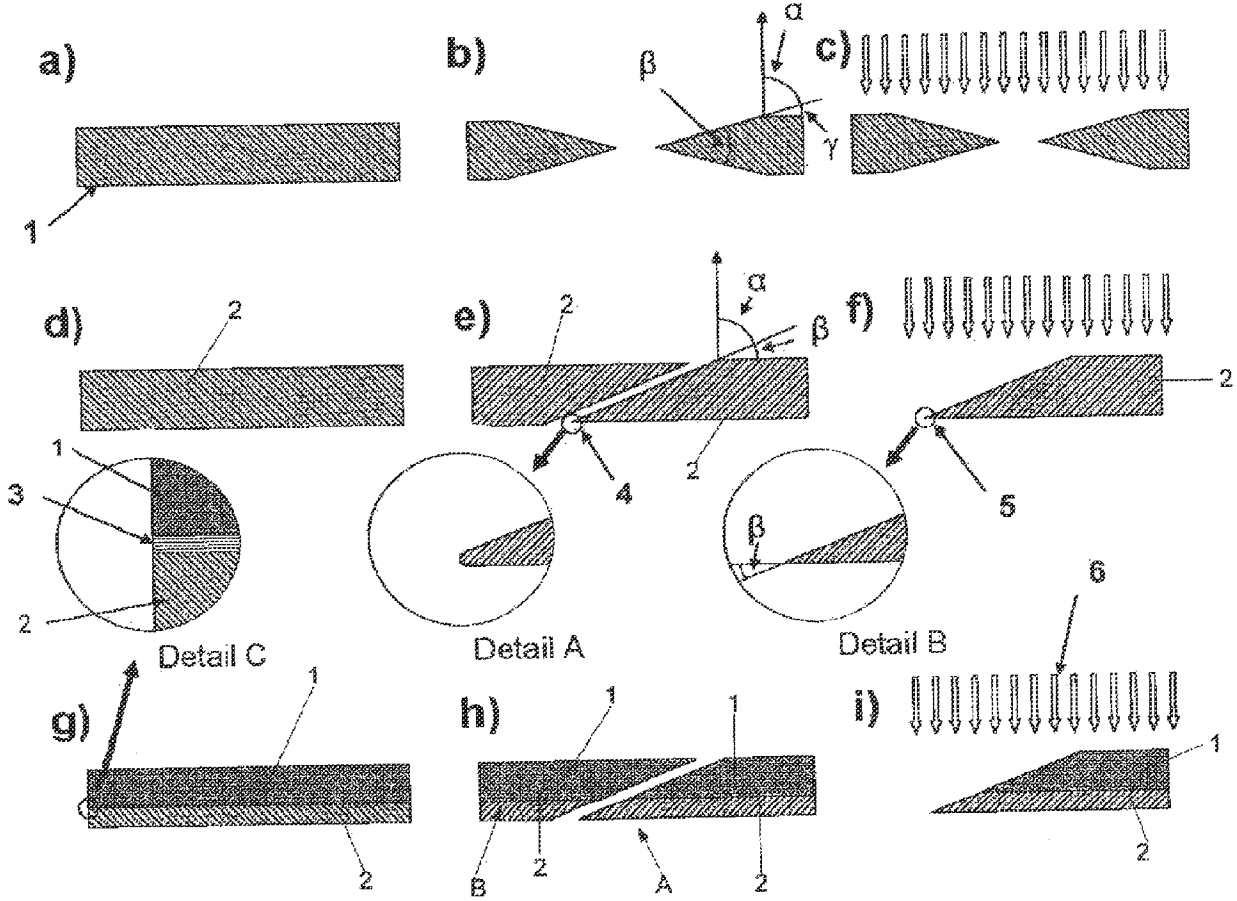
Figure 3:
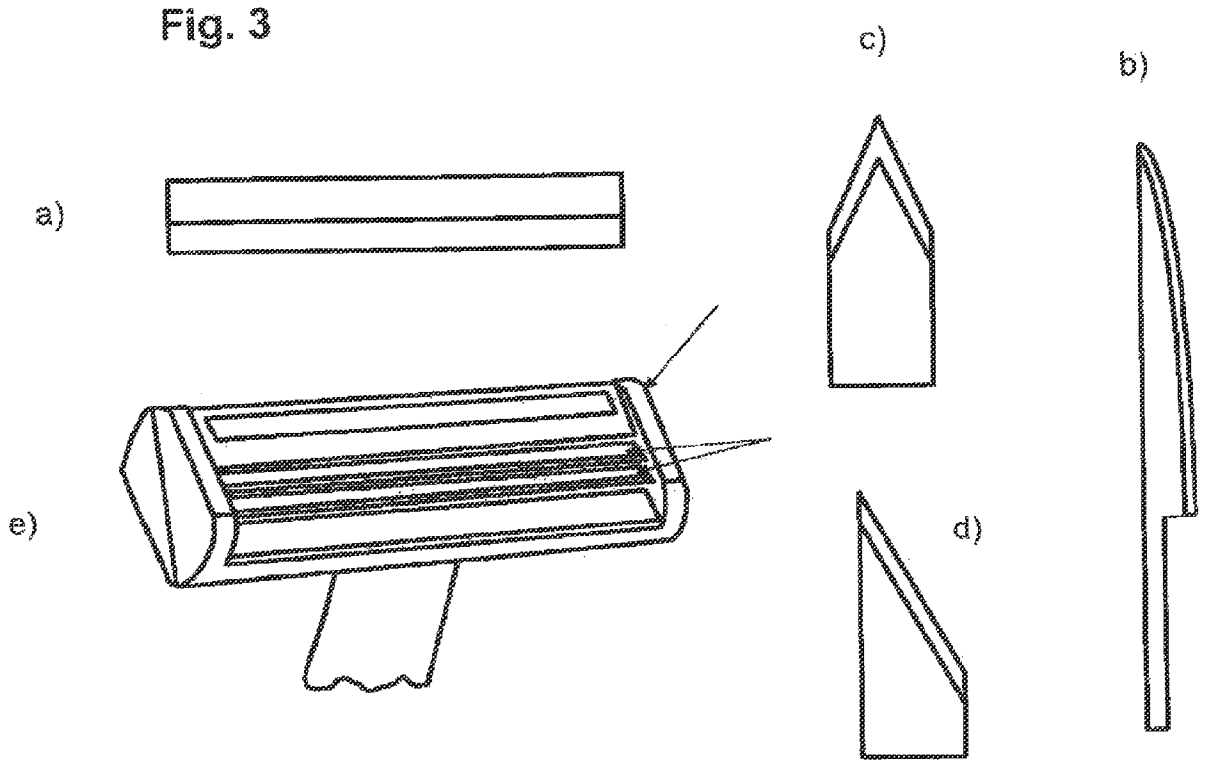
Figure 4:
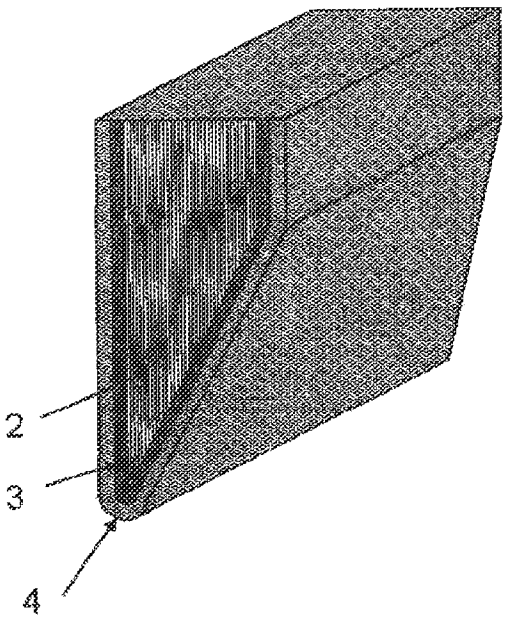
Figure 5:
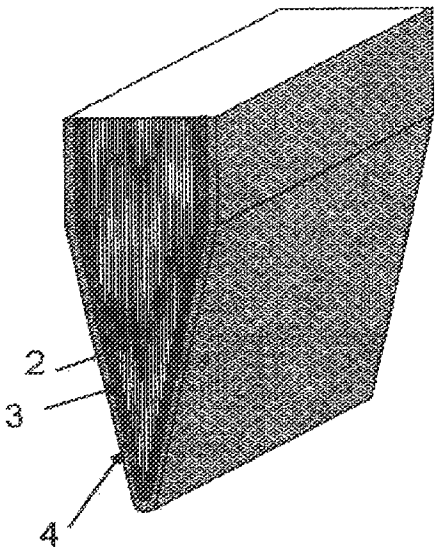

Further details and preferred embodiments of the invention are revealed in the embodiments, given by way of example, and the Figures, the Figures not being to scale. There are shown:

FIG. 1 a comparison of three types of blades, namely a) a complete diamond blade made of monocrystalline diamond (state of the art), b) a complete diamond blade made of polycrystalline diamond (state of the art), and also c) a complete diamond blade according to the invention made of fine-crystalline diamond (according to the invention);

FIG. 2 various variants of the method according to the invention for the production of the cutting tool according to the invention;

FIG. 3 various forms of cutting tools according to the invention;

FIGS. 4 and 5 two embodiments of a cutting tool according to the invention with different geometries of the cutting edge.

Figure 6:
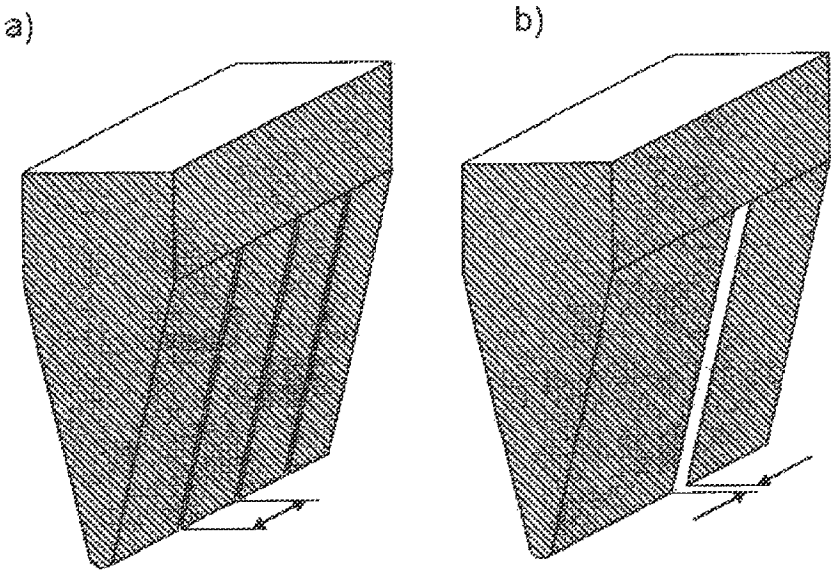

FIG. 6 a further embodiment of a cutting tool according to the invention with notches.

FIG. 1 shows three different variants of blades which are formed respectively completely from diamond.

FIG. 1*a* shows a blade which consists of monocrystalline diamond. However, it is extremely difficult to produce monocrystalline diamond in a macroscopic configuration, such as for example blades, in an efficient reproducible manner so that such blades are obtainable only in a limited piece number and in addition are very expensive. Likewise, the rounded radius r of the cutting edge is indicated (detail D).

FIG. 1*b* shows, as standard, complete diamond blades known from the state of the art which are based on polycrystalline diamond material. In FIG. 1*b*, the polymorphism of the disposed crystallite domains of the polycrystalline material is represented schematically. During a cutting process at the edge, the result with the high cutting forces occurring here can be that individual crystallites detach from the blade, in particular in the region preferably along grain boundaries of the cutting edge (see detail A) so that the blade has increased jaggedness for example even when used for the first time. The result hereof is an extremely non-homogeneously configured cutting edge which considerably impairs the cutting ability and the edge-holding property of such a blade.

In FIG. 1*c*, a blade according to the invention made of nano- or fine-crystalline diamond material is represented. In comparison to the polycrystalline diamond blade illustrated in FIG. 1*b* it is noticeable that the average size, i.e. the diameter $d_{50}$, of the respective crystallite domains, is configured smaller by a multiple than in the case of polycrystalline diamond (cf. in particular detail A and B). It is thereby particularly advantageous that the flaking of the blade in the cutting region is substantially reduced in comparison to the pronounced shape of the polycrystalline diamond according to FIG. 1*b* since the crystallites which can possibly detach are substantially less pronounced. Hence damage to the blade, in comparison to FIG. 1*b*, can be established merely on a microscopic scale so that the macroscopic structure of the cutting edge of the blade according to FIG. 1*c* remains essentially unimpaired. In this respect, a significant increase in the edge-holding property (constant sharpness) even with fairly long use of the blade can be observed. The nanocrystalline crystallite domains of a blade according to FIG. 1*c* are thereby below 500 nm, whilst polycrystalline diamond crystal domains have an average order of magnitude of the crystallite domains $d_{50}$ between 2 and 100 μm.

FIG. 2 shows three alternative variants for the production of the cutting tool according to the invention by means of the method according to the invention, which variants are represented respectively in the Figure sequence 2*a*) to 2*c*), 2*d*) to 2*f*) and 2*g*) to 2*i*).

The method variant, as represented in the Figure sequence 2*a*) to 2*c*), starts with a produced fine-crystalline diamond layer 2. This fine-crystalline diamond layer can be produced via methods known from the state of the art, for example as described above by way of example.

The diamond layer 1 is cut in a step represented in FIG. 2*b*), a cutting process is implemented thereby twice, respectively at an angle α to the surface normal (represented as an arrow in FIG. 2*b*). A symmetrical blade which is subjected to a plasma sharpening method in a step represented in FIG. 2*c*) is thereby produced. It is thereby evident that the relationship $\alpha+\gamma=90°$ with $\gamma=\beta/2$ applies. α thereby represents the angle to the surface normal of the diamond layer, at which the diamond layer is cut from both sides and 3 represents the cutting angle.

According to an alternative embodiment of the method (step sequence represented in FIGS. 2*d*) to 2*f*), steps represented analogously to those in FIGS. 2*a* to 2*c* are performed, however an asymmetrical blade is formed. $\alpha+\beta=90°$ applies here.

In a step represented in FIG. 2*e*), cutting of the diamond layer 2 is effected, for example the method can be implemented by means of a laser. With respect to the surface normal which is indicated with the arrow in FIG. 2*e*), cutting of the diamond layer 2 is effected at an angle α. A cutting edge is thereby produced in both resulting fragments, the cutting edge thereby has the cutting angle β which corresponds to the angle α via the relationship $\alpha+\beta=90°$. As is evident in detail A, the produced cutting edge is still not sufficiently sharp after completion of the cutting process. In a step represented in FIG. 2*f*), resharpening of the cutting edge takes place via a plasma- or ion etching method. As is evident in detail B, after completion of the sharpening process, the cutting edge is substantially sharper than before the process. These embodiments apply likewise to the step sequence represented in FIGS. 2*a*) to 2*c*).

In the third method variant represented in FIG. 2 (step sequence according to FIGS. 2*g*) to 2*i*)), a diamond layer 2 which is applied on a substrate 1 is started with. Between substrate 1 and diamond layer 2, further layers can be disposed, such as e.g. the adhesive layer 3 represented in detail c. This composite is cut in the step sequence in FIG. 2*h*) likewise at an angle α to the surface normal so that two fragments A and B are produced. In fragment A, likewise a—still insufficiently sharp cutting edge in the diamond layer 2 is thereby already produced, which can be resharpened analogously to the step according to FIG. 2*f*) in a subsequent sharpening process (step according to FIG. 2*i*)) by means of plasma- or ion etching processes. In order to be able to form a cutting edge in the diamond layer 2 also in the fragment B produced in the step according to FIG. 2*h*), the cut projection of the substrate layer 1 must also be removed (not represented). This can be effected for example by a new cutting process so that, after corresponding processing, a further fragment is present which corresponds to fragment A, as represented in FIG. 2*h*).

FIG. 3 shows various embodiments of the cutting tool according to the invention, for example in the form of a machine knife a), a kitchen knife b) or differently designed blades c) or d). Razor blades are likewise possible (see e)).

FIG. 4 shows a special embodiment in which the cutting tool is based on a fine-crystalline diamond layer 2. This cutting tool represents a complete diamond blade. On the diamond layer 2, an adhesive layer 3 and also a sliding layer 4 applied on the adhesive layer 3 are configured. The adhesive layer 3 can thereby consist preferably of metals, such as for example chromium, platinum, titanium, silicon or tungsten. These metals can be vapour-deposited or sputtered, e.g. by CVD or PVD processes, onto the diamond layer 2 which forms the blade. For the sliding layer 4 there are possible in particular polymeric materials, e.g. PTFE. However also carbon-based sliding layers, such as e.g. DLC or graphite, are possible. In FIG. 4, an embodiment of the cutting tool is represented, the cutting edge having an asymmetrical configuration.

FIG. 5 shows essentially the same embodiment as FIG. 4, only that here merely the cutting tool has a symmetrical configuration with respect to the cutting edge.

In FIG. 6, a further embodiment of the diamond blade is represented, which has notches in the cutting edge. The notches are thereby configured continuously through the diamond blade and can be configured for example, as represented in FIG. 6*a*, at regular spacings. The regular spacing represented here can be for example less than 10 mm, e.g. 5 mm. FIG. 6*b* shows a further variant of the blade, in which the notch has a wider configuration, the width of such a notch can be for example between 0.01 and 1 mm and serves for guidance of the blade relative to the item to be cut.

The invention claimed is:

1. A cutting tool with a synthetic diamond layer which has a cutting edge, the cutting edge having a profile with a reducing layer thickness, wherein the diamond layer includes at the cutting edge a rounded radius r between 3 nm and 100 nm and fine-crystalline diamond with an average grain size $d_{50} \leq 500$ nm and with a proportion of sp- and $sp^2$-bonds being between 0.5 to 10%.

2. The cutting tool according to claim 1, wherein the cutting angle β is between 10° and 40°.

3. The cutting tool according to claim 1, wherein the ratio between the rounded radius r of the diamond layer at the cutting edge and the average grain size $d_{50}$ of the fine-crystalline diamond $r/d_{50}$ is between 0.03 and 20.

4. The cutting tool according to claim 1, wherein the cutting tool is formed completely from the diamond layer, the diamond layer having a thickness of up to 10 to 1,000 μm.

5. The cutting tool according to claim 1, wherein the diamond layer is disposed on a substrate material, the diamond layer having a thickness of up to 1 and 500 μm.

6. The cutting tool according to claim 5, wherein the substrate material is selected from the group consisting of metals, such as titanium, nickel, chromium, niobium, tungsten, tantalum, molybdenum, vanadium, platinum, iron-containing materials, including at least one of steel and germanium; from at least one of a group including carbon-, nitrogen- and boron-containing ceramics, such as silicon carbide, silicon nitride, boron nitride, tantalum carbide, tungsten carbide, molybdenum carbide, titanium nitrides, one of a group including TiAlN, TiCN and $TiB_2$, glass ceramics; composite materials made of ceramic materials in a metallic matrix (cermets); hard metals; sintered carbide hard metals, such as e.g. cobalt- or nickel-bonded tungsten carbides or titanium carbides; silicon, glass or sapphire; and at least one of a group including mono-, polycrystalline diamond and diamond-like carbon layers.

7. The cutting tool according to claim 1, wherein the gradient of the average grain size of the fine-crystalline diamond, measured in the direction of the thickness of the fine-crystalline diamond layer, is <300%.

8. The cutting tool according to claim 6, wherein, there is applied, between the substrate and the fine-crystalline diamond layer, at least one first adhesive layer, made of silicon carbide, silicon nitride, tungsten, titanium, or silicon.

9. The cutting tool according to claim 1, comprising, on the fine-crystalline diamond layer, at least one second adhesive layer, and thereupon a sliding layer, in particular a polymer layer being a DLC layer.

10. The cutting tool according to claim 1, wherein the diamond layer has an average surface roughness of $R_A < 5$ μm.

11. The cutting tool according to claim 1, wherein the cutting edge has notches or cuts at regular spacings of less than 10 mm.

12. The cutting tool according to claim 1, wherein the crystallites of the fine-crystalline diamond layer are especially <100>-, <110>- or <111>-textured.

13. The cutting tool according to claim 1, produced by a process comprising:

a) provision of a synthetic, fine-crystalline diamond layer;

b) one- or two-sided cutting of the fine-crystalline diamond layer at an angle α which is between 50° and 85°, to the surface normal of the fine-crystalline diamond layer, at least one fragment with a cutting edge being produced; and c) resharpening of the cutting edge by means of a plasma- or ion etching process.

14. A system, comprising:

a cutting tool with a synthetic diamond layer which has a cutting edge, the cutting edge having a profile with a reducing layer thickness, wherein the diamond layer includes at the cutting edge a rounded radius r between 3 nm and 100 nm and fine-crystalline diamond with an average grain size $d_{50} < 500$ nm and with a proportion of sp- and $sp^2$-bonds being between 0.5 to 10%, wherein the tool is configured as a sharpening surface in a receptacle sized to receive at least one of a group including a blade, a knife blade, a razor blade, a blade of a shaving system, a scalpel, a knife, a machine knife, a scissors and a shearing machine.

15. The system according to claim 14, wherein the cutting angle β is between 10° and 40°.

16. The system according to claim 14, wherein the ratio between the rounded radius r of the diamond layer at the cutting edge and the average grain size $d_{50}$ of the fine-crystalline diamond $r/d_{50}$ is between 0.03 and 20.

17. The system according to claim 14, wherein the system is formed completely from the diamond layer, the diamond layer having a thickness of up to 10 to 1,000 μm.

18. The system according to claim 14, wherein the diamond layer is disposed on a substrate material, the diamond layer having a thickness of up to 1 and 500 μm, and wherein the substrate material is selected from the group including metals, such as titanium, nickel, chromium, niobium, tungsten, tantalum, molybdenum, vanadium, platinum, iron-containing materials, including at least one of steel and germanium; from at least one of carbon-, nitrogen- and boron-containing ceramics, such as silicon carbide, silicon nitride, boron nitride, tantalum carbide, tungsten carbide, molybdenum carbide, titanium nitrides, at least one of the group including TiAlN, TiCN and $TiB_2$, glass ceramics; composite materials made of ceramic materials in a metallic matrix (cermets); hard metals; sintered carbide hard metals, such as e.g. cobalt- or nickel-bonded tungsten carbides or titanium carbides; silicon, glass or sapphire; and also at least one of a group including mono-, polycrystalline diamond and diamond-like carbon layers.

19. The cutting tool according to claim 1, wherein the gradient of the average grain size of the fine-crystalline diamond, measured in the direction of the thickness of the fine-crystalline diamond layer, is <100%.

20. A cutting tool with a synthetic diamond layer which has a cutting edge, the cutting edge having a profile with a reducing layer thickness, wherein the diamond layer includes fine-crystalline diamond with an average grain size $d_{50}$<500 nm and with a proportion of sp- and $sp^2$-bonds being between 0.5 to 10%, and wherein, there is applied, on the fine-crystalline diamond layer, at least one second adhesive layer, made of Cr, Pt, Ti, or W, and thereupon a sliding layer, in particular a polymer layer including a PTFE layer, a carbon layer, including at least one of a graphite layer and a DLC layer.

* * * * *